US011116999B1

(12) United States Patent
Novosel

(10) Patent No.: US 11,116,999 B1
(45) Date of Patent: Sep. 14, 2021

(54) SHAPE-RETAINING FILTERING MASK

(71) Applicant: Frank Novosel, Mercer Island, WA (US)

(72) Inventor: Frank Novosel, Mercer Island, WA (US)

( * ) Notice: Subject to any disclaimer, the term of this patent is extended or adjusted under 35 U.S.C. 154(b) by 0 days.

(21) Appl. No.: 16/904,127

(22) Filed: Jun. 17, 2020

(51) Int. Cl.
*A62B 23/02* (2006.01)
*A41D 13/11* (2006.01)

(52) U.S. Cl.
CPC ..... *A62B 23/025* (2013.01); *A41D 13/11* (2013.01); *A41D 13/1115* (2013.01); *A41D 13/1138* (2013.01); *A41D 13/1161* (2013.01)

(58) Field of Classification Search
CPC . A41D 13/11; A41D 13/1107; A41D 13/1115; A41D 13/1123; A41D 13/113; A41D 13/1138; A41D 13/1161; A41D 13/1176; A62B 23/025
USPC ..... 128/863, 206.21, 206.28, 207.11; 2/9, 2/173, 206
See application file for complete search history.

(56) References Cited

U.S. PATENT DOCUMENTS

| | | | | |
|---|---|---|---|---|
| 3,974,829 | A | 8/1976 | Tate | |
| 4,037,593 | A | 7/1977 | Tate | |
| 4,662,005 | A | 5/1987 | Grier-Idris | |
| 5,803,075 | A | 9/1998 | Yavitz | |
| 6,332,465 | B1 * | 12/2001 | Xue | A41D 13/1161 128/207.11 |
| 8,910,634 | B2 * | 12/2014 | Lu | A62B 23/025 128/206.19 |
| 10,368,601 | B2 | 8/2019 | Greenblat et al. | |
| 10,561,181 | B2 | 2/2020 | Pearson | |
| 2012/0000473 | A1 * | 1/2012 | Shigematsu | A41D 13/113 128/863 |
| 2015/0173436 | A1 * | 6/2015 | Tsuei | A41D 13/1115 2/424 |
| 2019/0299034 | A1 | 10/2019 | Bora | |
| 2020/0121004 | A1 | 4/2020 | Loughran | |

FOREIGN PATENT DOCUMENTS

| | | | |
|---|---|---|---|
| JP | 2019090134 | B1 | 6/2019 |
| KR | 102060979 | B1 | 12/2019 |
| TW | 145100 | B1 | 1/1990 |
| WO | 2005067753 | A1 | 7/2005 |

* cited by examiner

*Primary Examiner* — Keri J Nelson
(74) *Attorney, Agent, or Firm* — Timothy E. Siegel Patent Law, PLLC; Timothy E. Siegel

(57) ABSTRACT

An air-filtering mask including a piece of air-filter material. A set of mask-retention tension members, are attached at the right and left sides of this material for fixing the mask about the head in a preferred position wherein the air-filter material top extends across the face at a level coincident with the bridge of the nose of the face. Further, a shape-preserving tension member is attached at a left attachment point at the left side of the material and extends to and is attached to a right attachment point, and is retained at the top-center of the material, the shape-preserving tension member being shorter than the extent of the material between the attachment points, so that the material is loose between the attachment points and is not pulled taut, thereby facilitating conformance of the top of the air filter material to the contours of the face.

18 Claims, 2 Drawing Sheets

SHAPE-RETAINING FILTERING MASK

BACKGROUND OF THE INVENTION

Filtering masks, always a ubiquitous presence in public health settings have, as of this writing, received increased attention as a way of preventing the spread of Covid-19. These masks typically have some pleated sheet of filter material that goes over the nose and mouth, a fabric hem about this filter material, and some attachment strings for tying the mask about the head. Some masks include a nose-bridge strip, comprising a piece of easily deformable metal, set at the location which is naturally placed at the bridge of the nose when the mask is worn. A user may bend this material to fit the bridge of his or her nose, thereby providing a more conformal fit over the bridge of the nose, and then the slight depression at the bottom of each eye. For those who wear eyeglasses, having a good fit at the top of the mask is of particular importance, to prevent the eyeglasses from fogging up, something which could be dangerous in a surgical environment. Dust masks that are typically used in construction typically also include a nose-bridge strip.

Unfortunately, the tension of the strings that attach the mask to the head tend to pull against the nose-bridge strip, causing it to straighten out. Accordingly, a wearer may find himself interrupting his actions to reshape this strip. The need to reform the strip may serve as a distraction from the important work of a health care professional. Further, this action may even spread contagion, as the health care professional may not have time to wash his or her hands before making a much-needed reshaping of the strip.

SUMMARY OF INVENTION

The following embodiments and aspects thereof are described and illustrated in conjunction with systems, tools, and methods which are meant to be exemplary and illustrative, not limiting in scope. In various embodiments, one or more of the above-described problems have been reduced or eliminated, while other embodiments are directed to other improvements.

In a first separate aspect, the present invention may take the form of an air-filtering mask to be worn on a human head, having a face, and including a piece of air-filter material having a top and a bottom and right and left sides. A set of mask-retention tension members, are attached at the right and left sides for fixing the mask about the head in a preferred position wherein the air-filter material top extends across the face at a level coincident with the bridge of the nose of the face. Further, a shape-preserving tension member is attached at a left attachment point at the left side of the material and extends to and is attached to a right attachment point at the right side of the material, and retained at the top-center of the material, the shape-preserving tension member being shorter than the extent of the material between the attachment points, so that the material is loose between the attachment points and is not pulled taut, thereby facilitating conformance of the top of the air filter material to the contours of the face.

In a second separate aspect, the present invention may take the form of a method of filtering breath of a person. The method utilizes a mask having a piece of air-filter material having a top and a bottom and right and left sides, and a set of mask-retention tension members, attached at the right and left side of the filter material. Further, a shape-preserving tension member is attached at a left attachment point at the left side of the material and extending to and attached to a right attachment point at the right side of the material. The shape-preserving tension member is shorter than the extent of the material between the attachment points, so that the material is loose between the attachment points and is not pulled taut, causing the nose-bridge strip to deform, when the mask retention tension members are pulled. In the method, the mask is placed on the person's head, so that it is retained about the head by the mask-retention tension members with the piece of material covering the nose and mouth of the person. Further, wherein the shape-preserving tension member extends across the bridge of the nose of the person and prevents tension being placed on the material between the attachment points.

BRIEF DESCRIPTION OF DRAWINGS

Various embodiments of the invention are disclosed in the following detailed description and accompanying drawings.

DETAILED DESCRIPTION AND EMBODIMENTS

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Definitions: In this application the term "set" includes a set having a single member only. Terms in plural may refer to a singular item.

To assist the description of the scope and its components the coordinate terms "top", "bottom", "left" and "right" are used to describe the disclosed embodiments. The terms are used consistently with the description of the exemplary applications and are in reference to a preferred orientation for the mask to be worn on the head of a wearer.

Figure 1:
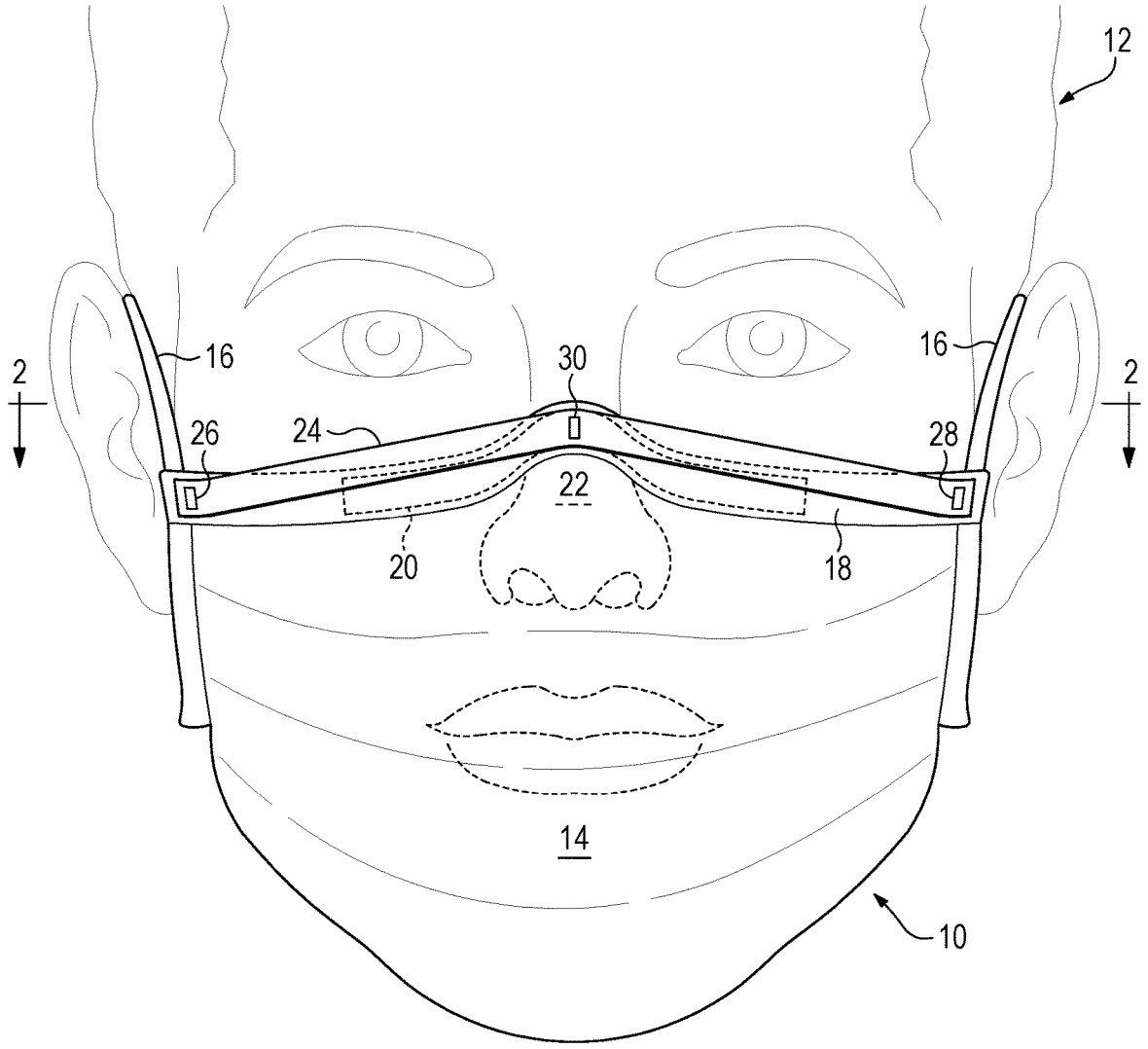
FIG. 1 is a front environmental view, showing a surgical mask, according to the present invention, being worn on a person's face.
Figure 2:
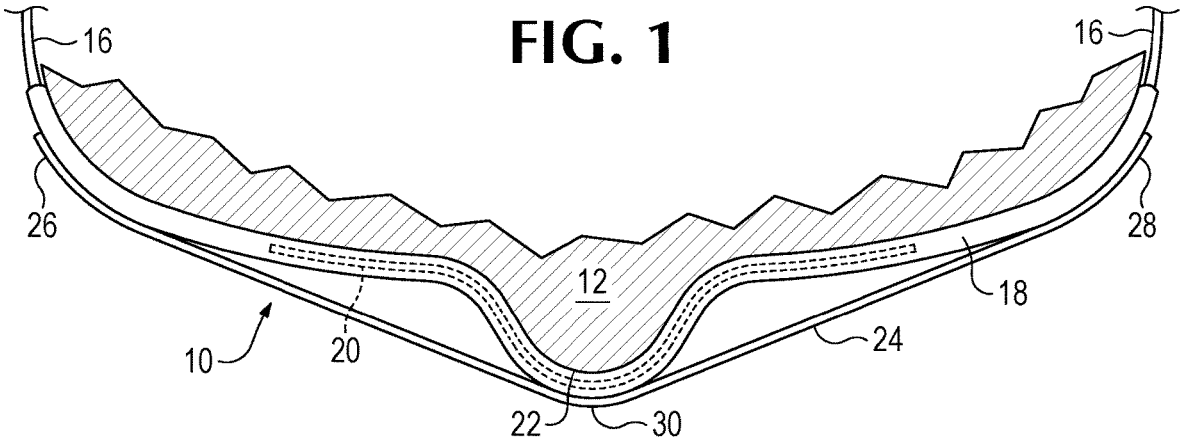
FIG. 2 is a top view of the environmental configuration of FIG. 1.

Referencing FIGS. 1 and 2, a filtering mask, in the specific form of a surgical mask 10 is shown being worn on a person's face 12 in a preferred orientation, in which it has a top and bottom, and left and right, according to familiar convention. Similar to standard surgical masks, mask 10 includes a flexible, pleated sheet of filter material 14 held in place on the face by left and right attachment members 16, in this case elastic bands looped about the ears, as is frequently the case, having top-right, bottom-right, top-left and bottom-left attachment points to material 14, as shown. In other variations, however, left and right top strings and left and right bottom strings are each tied together about the back of the head. A liner 18 extends about material 14, preventing tension from members 16 from tearing material 14. Material 14 is most frequently a flexible sheet of filter material made to have a small enough pore size to block microbes and other small particulates from passing through. In one embodiment, a nose-bridge strip 20, such as a thin strip of deformable metal, is provided about the nose 22, to permit the wearer to shape the top of mask 10 to the profile of the bridge of his or her nose 22. In an alternative embodiment, there is no nose-bridge strip. In a variant, the mask is made of fabric that is sewn, so as to naturally have a shape accommodates the contours of the face, around the nose and eyes. In another embodiment, nose-bridge strip 20 is resiliently deformable. Some polymer materials have this quality, and strip 20 of polymer of this sort in the shape of a bow, is used to bend gently about the bridge of the nose. In yet another alternative embodiment, pieces of metal or polymer material in bow shapes are incorporated into the mask to cause the mask to bow towards the face at the places near the eyes where there is a slight depression in the face profile.

Face mask 10 further includes a shape-preserving tension member 24, that extends from a first attachment point 26 to a second attachment point 28 and, in one embodiment, is sewn at a central point 30 to the liner 18, thereby being attached to a top-central point of the filter material 14. Importantly, tension member 24 is shorter than the extent of material 14 between attachment points 26 and 28, so that material 14 is loose between these attachment points, and tension from attachment tension members 16 will not deform nose-bridge strip 20. In an alternative embodiment, tension member 24 extends from point 26 to point 28 without being sewn to liner 18 at central point 30. In an alternative embodiment, tension member 24 is comprised of two tension members that are both attached at or near a central point of liner 18. Because these two tension members act as a single tension member, whether they are directly joined or both attached to liner 18 or material 14 near to each other, they act as and form single tension member 24. Tension member 24 prevents the attachment members 16 from pulling at liner 18, and thereby deforming nose-bridge strip 20. In an embodiment, tension member 24 is retained on liner 18 or material 14, through hook and loop material. In a further embodiment, tension member 24 is retained on liner 18 or material 14 by an adhesive, which in an embodiment is a weak adhesive.

In an alternative preferred embodiment, filter material 14 is not in the form of a pleated sheet, but rather in a formed shape, that defines a concavity for accepting the portion of the face that includes the nose and mouth. This type of mask is frequently used in construction as a dust-filtering mask. In embodiments, tension member 24 is in the form of a tape, as shown in the drawings.

Figure 3:
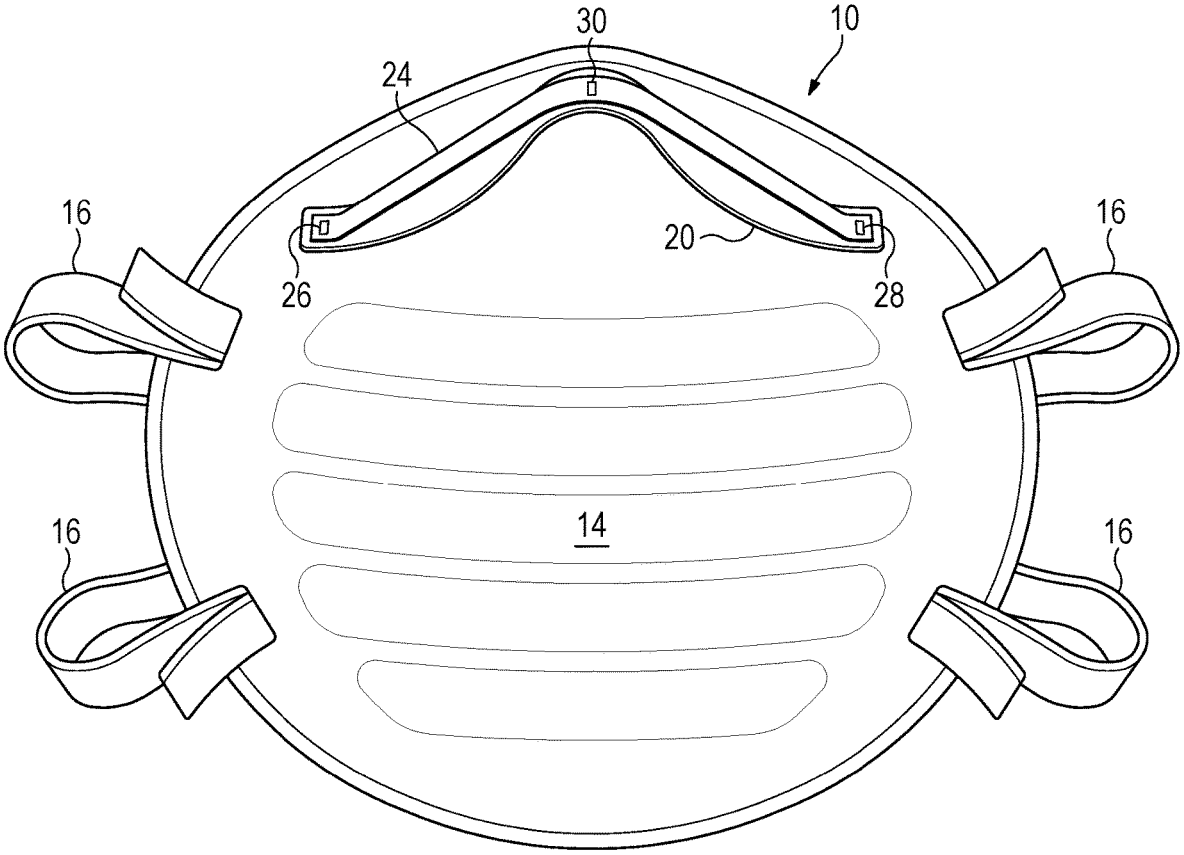
FIG. 3 is a front view of a particulate mask, having shaped filter material, according to the present invention.

Referring to FIG. 3, in a further embodiment of mask 10, filter material 14 is more rigid than the material 14 of FIGS. 1 and 2 and is shaped into a rounded cup. Nose-bridge strip 20 is longer, and shape-retaining tension member 24 goes only from one side of strip 20 to the other, preventing tension from elastic tension member 16 from pulling it out of shape. Tension member 24 is retained on strip 20, in one embodiment, by heat welding.

The disclosed embodiments are illustrative, not restrictive. While specific configurations of the air-filtering mask have been described, it is understood that the present invention can be applied to a wide variety of mask types. There are many alternative ways of implementing the invention.

What is claimed is:

1. An air-filtering mask to be worn on a human head, having a face, in a preferred orientation relative to said face, thereby defining an outside, which faces away from said face in said preferred orientation, and comprising:

a. a flexible sheet of air-filter material having a top and a bottom and right and left sides, b. a set of mask-retention tension members, attached at said right and left sides for fixing said mask about said head in a preferred position wherein said flexible sheet top is configured to extend across said face at a level coincident with the bridge of the nose of said face; and c. a shape-preserving elongate tension member attached at a left attachment point at said left side and on said outside of said flexible sheet and extending to and attached to a right attachment point at said right side and on said outside of said flexible sheet, and retained at a top-center of said flexible sheet, said top of said flexible sheet being unattached to said shape-preserving elongate tension member between said left attachment point and said top-center of said flexible sheet, and between said top-center of said flexible sheet and said right attachment point, said shape-preserving elongate tension member being shorter than the extent of said flexible sheet between said attachment points, so that said flexible sheet is loose between said attachment points and is not pulled taut, thereby facilitating conformance of said top of said flexible sheet to the contours of said face.

2. The air-filtering mask of claim 1, further having a nose-bridge strip, made of deformable flexible sheet that can be shaped to the profile of the bridge of the nose of said human head, and wherein said shape-preserving elongate tension member prevents said nose-bridge strip from being pulled out of its shape by tension from said mask-retention tension members.

3. The air-filtering mask of claim 2, wherein said shape-preserving elongate tension member is also attached to said flexible sheet of air-filter material at a point proximal to a center-point of said nose-bridge strip.

4. The air-filtering mask of claim 3, wherein said shape-preserving elongate tension member is attached to said flexible sheet of air-filter material, by being sewn to it.

5. The air-filtering mask of claim 3, wherein said shape-preserving elongate tension member is comprised of a right tension member and a left tension member joined together at a point proximal to a center-point of said nose-bridge strip.

6. The air-filtering mask of claim 1, further having a nose-bridge strip, made of resiliently deformable flexible sheet shaped and positioned to bend about the bridge of the nose of said face, and wherein said shape-preserving elongate tension member prevents said nose-bridge strip from being pulled out of its shape by tension from said mask-retention tension members.

7. The air-filtering mask of claim 1, wherein said set of mask-retention tension members are attached to said flexible sheet at a top-left, a top-right, a bottom-left and a bottom-right attachment point, and said left attachment point is adjacent to said top-left attachment point and said right attachment point is proximal to said top-right attachment point.

8. The air-filtering mask of claim 7, wherein said mask-retention tension members are a left and a right elastic loop, adapted to be hitched about the ears.

9. The air-filtering mask of claim 7, wherein said mask-retention tension members are a left and right, top and bottom strings, adapted to be tied together at the back of said human head.

10. The air-filtering mask of claim 1, wherein said shape-preserving elongate tension member is a tape.

11. The air-filtering mask of claim 1, further including a liner sewn about at least said top of said flexible sheet.

12. A method of filtering breath of a person, comprising:

a. providing a mask comprising:

i. a flexible sheet of air-filter material having a top and a bottom and right and left sides;

ii. a set of mask-retention tension members, attached at said right and left side of said flexible sheet of air-filter material;

iii. a shape-preserving elongate tension member attached at a left attachment point at said left side of said flexible sheet and extending to and attached to a right attachment point at said right side of said flexible sheet said shape-preserving elongate tension member being shorter than the extent of said flexible sheet between said attachment points, so that said flexible sheet is loose between said attachment points and is not pulled taut;

b. placing said mask on said person's head, so that it is retained about said head by said mask-retention tension members with said flexible sheet covering the nose and mouth of said person; and c. wherein said shape-preserving elongate tension member prevents tension being placed on the flexible sheet between said attachment points.

13. The method of claim 12, wherein said mask further comprises a nose-bridge strip, made of deformable flexible sheet, positioned at said top of said flexible sheet of air-filter material, about midway between said right and left sides, and wherein said shape-preserving elongate tension member prevents tension from being placed on said nose-bridge strip, thereby preventing deformation of said nose bridge strip.

14. The method of claim 13, wherein said nose-bridge strip is resiliently deformable.

15. The method of claim 13, further including the step of shaping said nose-bridge strip to fit the shape of the nose of the person.

16. The method of claim 13, wherein said shape-preserving elongate tension member is also attached to said flexible sheet at a point proximal to a center-point of said nose-bridge strip.

17. The method of claim 16, wherein said shape-preserving elongate tension member is comprised of a right tension member and a left tension member joined together at a point proximal to a center-point of said nose-bridge strip.

18. The method of claim 12, wherein said set of mask-retention tension members are attached to said flexible sheet at a top-left, a top-right, a bottom-left and a bottom-right attachment point and said left attachment point is proximal to said top-left attachment point and said right attachment point is proximal to said top-right attachment point.

* * * * *